US012435916B2

(12) United States Patent
Gesualdo

(10) Patent No.: US 12,435,916 B2
(45) Date of Patent: Oct. 7, 2025

(54) INDIVIDUAL TUBULAR PACKAGING MADE OF IMPERMEABLE PAPER FOR PACKAGING DRINKING/MINERAL WATER OR OTHER LIQUID SUBSTANCES FOR ICE FORMATION

(71) Applicant: Jose Roberto Gesualdo, Belo Horizonte (BR)

(72) Inventor: Jose Roberto Gesualdo, Belo Horizonte (BR)

( * ) Notice: Subject to any disclaimer, the term of this patent is extended or adjusted under 35 U.S.C. 154(b) by 290 days.

(21) Appl. No.: 17/765,332

(22) PCT Filed: Sep. 28, 2020

(86) PCT No.: PCT/BR2020/050382
§ 371 (c)(1),
(2) Date: Mar. 30, 2022

(87) PCT Pub. No.: WO2021/062504
PCT Pub. Date: Apr. 8, 2021

(65) Prior Publication Data

US 2022/0381498 A1 Dec. 1, 2022

(30) Foreign Application Priority Data

Sep. 28, 2019 (BR) ..... 20 2020 019691 5
Oct. 1, 2019 (BR) ..... 20 2019 020604 2

(51) Int. Cl.
*F25C 1/22* (2018.01)
*B65D 77/12* (2006.01)

(52) U.S. Cl.
CPC ..... *F25C 1/22* (2013.01); *B65D 77/12* (2013.01)

(58) Field of Classification Search
CPC ..... B65D 65/466; B65D 77/12; B65D 77/38; F25C 1/22; Y02W 90/10
See application file for complete search history.

(56) References Cited

U.S. PATENT DOCUMENTS 2,430,995 A 11/1947 William
4,223,043 A * 9/1980 Johnson ..... A23G 9/503 426/135

(Continued)

FOREIGN PATENT DOCUMENTS

BR MU9100862 U2 4/2013
JP 2011116394 A 6/2011

(Continued)

OTHER PUBLICATIONS

International Search Report, Nov. 16, 2020.

*Primary Examiner* — Frantz F Jules
*Assistant Examiner* — Martha Tadesse
(74) *Attorney, Agent, or Firm* — Bay State IP, LLC

(57) ABSTRACT

A packaging for drinking water/minerals or other liquid substances for individualized ice formation is disclosed, which provides for areas of expansion of the liquid for its transformation into ice and its tubular shape without damaging the packaging, i.e. the weak sealing (3) which provides for the expansion/expansion, which will be broken at the proposed end(s) and the expansion generated in the change of state from liquid to solid will be assimilated normally by the package conformation, but limited by the strong sealing (2) and stronger (4), avoiding early package rupture, ensuring its integrity, either for storage or after frozen for consumption.

4 Claims, 3 Drawing Sheets

(56) References Cited

U.S. PATENT DOCUMENTS

| | | | | | |
|---|---|---|---|---|---|
| 4,537,308 | A | | 8/1985 | Glass | |
| 5,131,760 | A | | 7/1992 | Farmer | |
| 5,494,598 | A | * | 2/1996 | Hughes | A45D 4/16<br>165/10 |

FOREIGN PATENT DOCUMENTS

| | | | | | |
|---|---|---|---|---|---|
| WO | 2012091674 | A1 | | 7/2012 | |
| WO | WO-2012116421 | A1 | * | 9/2012 | F25C 1/243 |

* cited by examiner

INDIVIDUAL TUBULAR PACKAGING MADE OF IMPERMEABLE PAPER FOR PACKAGING DRINKING/MINERAL WATER OR OTHER LIQUID SUBSTANCES FOR ICE FORMATION

CROSS REFERENCE TO RELATED APPLICATION

This application is for entry into the U.S. National Phase from which priority is claimed under all applicable sections of Title 35 of the United States Code including, but not limited to, Sections 120, 363, and 365(c) to International Application No. PCT/BR2020/050382 filed on Sep. 28, 2020, and which in turn claims priority under 35 USC 119 to Brazilian Application No. 2020190206042 filed on Oct. 1, 2019 and Brazilian Application No. 2020200196915 filed on Sep. 28, 2020.

FIELD OF USE

The present patent refers to an arrangement introduced in tubular packaging for packaging drinking/mineral water or other liquid for individualized ice formation, belonging to the packaging industry segment, whose innovation aims to provide greater hygienic safety in the consumption of ice in drinks to be consumed iced, besides, of course, individualizing the use of ice, without causing waste.

BACKGROUND

Brazil, as the other tropical countries, in particular have a large ice consumption market, having in the world.

With the onset of summer, specifically the factories double and even triple the volume of ice cube production in relation to other times of the year to ensure the great demand of bars, restaurants, hotels and the general public on the seashore.

A study commissioned by the Institute of Food Technology of São Paulo, pointed out that a high amount of organisms, such as bacteria, viruses, as well as mold and yeast, were found in several samples for analysis of ice for consumption, above 50 colony forming units per square centimeter (cfu/cm2).

The most common bacteria found and one of the most resistant to low temperatures is *Escherichia coli*, which is present in human feces and can cause serious illness.

Besides this, other organisms can also survive for more than seven days at sub-zero temperatures, according to a survey by the Health Protection Agency in England.

Some patents describe attempts to solve this problem, which is the contamination of ice by microorganisms that are harmful to human health.

However, in researches carried out in patent databases, several solutions were found that are part of the state of the art and that we will now describe those that are most representative.

The Brazilian patent document PI 9813551-1, "Ice cube bag and method for making ice cube bag" of Sep. 12, 1998, of priority and ownership of Schur Intellectuals A/S (DK), now lapsed, basically consists an ice cube bag with an opening for drinking water that has chambers divided into compartments for ice cube formation, each compartment being limited by a rupture weld that delimits each ice cube forming chamber, which when solidified can be easily separated from its mold.

That patent uses several compartments to form ice cubes simultaneously and, in order to use the ice cubes, it is necessary to remove all 24 ice cubes, which may cause the loss of all the ice if the set is not returned immediately to the freezer, unlike the proposal of the present patent, i.e., the mentioned patent does not aim at individualized and personalized use of the ice cube by the consumer.

The U.S. Pat. No. 4,813,646A, "Disposable plastic container for ices" dated Mar. 1, 1988, of priority of Sanei Kagaku Kogyo KK (JP), similar to the proposal of the Brazilian patent document cited above, is basically characterized by being a plastic container with an opening for the filling of drinking water in its various compartments, closed by a strip and bounded each chamber by a plurality of chamfers that limit the formation of cubes.

Its inconvenience is also that it is not individualized and personalized, because when it is removed from the refrigeration room, it will be necessary to use all the ice cubes produced.

The U.S. Pat. No. 3,601,252, "Burst pack" of Aug. 1, 1969, owned by Kleer Ind Inc, sought protection of a device for the formation of ice packs that aims to seal the ends of the package so that when pressed the package the sealing breaks, thus releasing the ice from the package, i.e., this document reveals a flexible package, that proposes to include at one of its ends a strong weld and at the opposite end a weak weld, whereby the package is opened by means of pressure on the side of the strong weld and rupture of the weak weld, however, this patent in practice presents an insoluble technical problem, because there is no provision for the expansion of the water to be solidified inside the package.

Thus, in practice, the packages would suffer early breakage before even being used.

The U.S. Pat. No. 3,890,448, "Heatable package of food" of Jun. 17, 1975, of priority of Toyo Seikan Kaisha Ltd, sought to protect a package for packaging products to be heated, design, construction and application absolutely different from the proposal of the present patent.

The U.S. Pat. No. 4,872,556A, "Packaging device with burst-open seal" of Nov. 2, 1987 owned by FARMER BERT (US), describes a packaging that can contain two chambers for liquids that can be distinct, for example ketchup and mustard or even for the medical field in which it would contain specific doses. Concepts and construction absolutely distinct from the subject matter of the present patent.

The patent documents MU9100634-1 and MU91008620, from the same owner of the present patent, describe products that represent the first researches of the object described here, which did not foresee the necessary expansion due to the dilatation of the liquid contained inside when frozen, which culminated in the early rupture of those packages.

SUMMARY

In view of the known state of the art, the present patent describes the solution proposed to overcome the inconveniences encountered and not yet solved regarding the way of producing individualized units of portions of water and other liquid substances to be frozen without contamination, consisting basically of an individualized tubular package that may be further customized and intended for the packaging of drinking/mineral water and liquids for ice formation, which may be used in countless ways, for example to be consumed with juices, cocktails, soft drinks or any other beverage, in a practical and convenient way without the possibility of contamination by handling.

Advantages of the packaging subject of this patent over the prior art:

- It has a tubular shape for packaging drinking/mineral water and other liquid substances to be sold without refrigeration and transformed into ice when placed in refrigerators or freezers in the commercial or domestic establishment;
- Elimination of contaminating agents, such as bacteria, viruses, or any other microorganisms that are harmful to human health;
- Ease of transportation of the packaging, without the need to transport it in refrigerated trucks to maintain its solidified state;
- Easy handling and removal of the ice for individualized and personalized use, with all safety and hygiene.

BRIEF DESCRIPTION OF THE FIGURES

FIG. 1A is a front view of the package (1) with the contents in the liquid state, strong safety welds (2) and expansion area with the weak weld (3) at one end;

FIG. 1B is a front view of the package (1) with the contents in the solid state, strong safety welds (2), with the weak weld (3) broken with the expansion done at one end;

FIG. 1C is a view of the back of the package (1) with the contents in the liquid state, strong safety welds (2), expansion area with the weak weld (3) at one end before expansion and the stronger longitudinal weld (4);

FIG. 1D is a view of the back of the package (1) with the contents in the solid state, strong safety welds (2), expansion area with the weak weld (3) at one end broken with the expansion made at one end and the stronger longitudinal weld (4);

FIG. 2A is a front view of the package (1) with the contents in the liquid state, strong safety welds (2) and expansion areas with the weak welds (3) at both ends;

FIG. 2B is a front view of the package (1) with the contents in the solid state, strong safety welds (2) with the weak welds (3) broken with expansion at both ends;

FIG. 2C is a view of the back of the package (1) with the contents in the liquid state, strong safety welds (2), weak weld (3) before expansion at both ends, and the strongest longitudinal weld (4);

FIG. 2D is a view of the back of the package (1) with the contents in the solid state, strong safety welds (2), weak welds (3) broken with expansion at both ends, and the strongest longitudinal weld (4).

DETAILED DESCRIPTION

Figure 1:
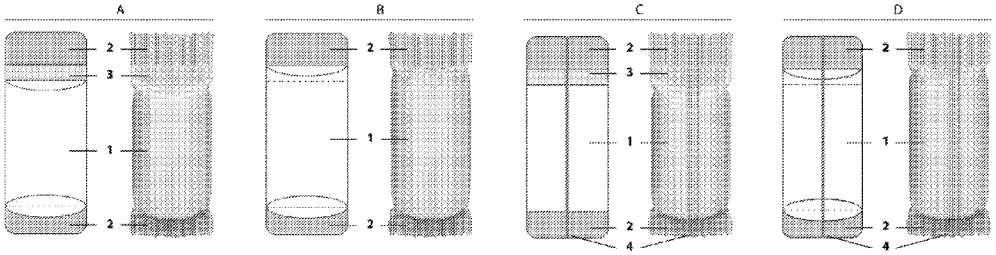
FIGS. 1 and 2 illustrate the preferred realization of the tubular package for packaging drinking/mineral water or other substance in liquid state for individualized ice formation and FIG. 3 an illustrative image of the package in the hands of a person to allow a better contextualization of the product, detailed illustrations are presented in the figures below where FIGS. 1 and 2 have visualizations A, B, C and D, being the images on the left side, visualizations in longitudinal cut and the ones on the right, views of the package ready for consumption.

The confection of the tubular packaging, object of the present patent, is performed with the use of impermeable paper and/or preferably biodegradable film (1), where the said packaging has a front area (A) and a back area (B), and the illustrations of FIG. 1 exemplify the realization where the ends have two areas of strong safety weld (2), to prevent early breakage when the liquid solidifies, an area of weak expansion weld (3) intended to compose the expansion area while allowing the ice to come out in a tubular format without deformation, and an area on the back of stronger longitudinal weld (4).

Figure 2:
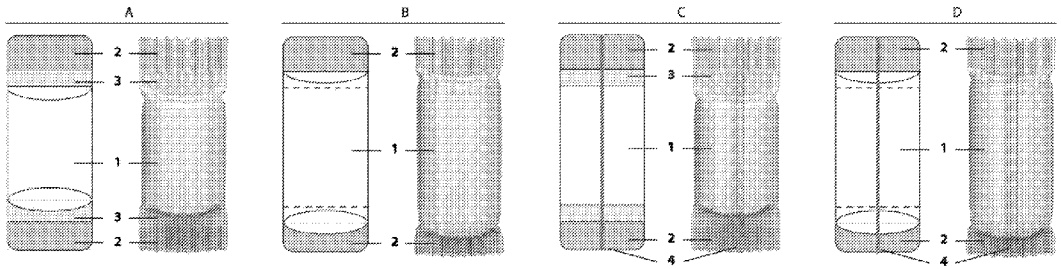
Figure 3:
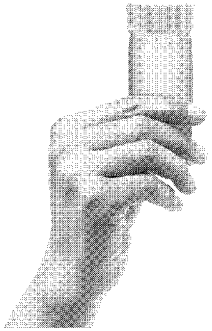

The images in FIG. 2, illustrate a constructive variant of the package of FIG. 1, where it uses the same raw material, waterproof paper and/or preferably biodegradable film (1), and which also has two areas of strong solder (2) and, in this version includes a second area of weak solder expansion (3), i.e. the weak solder (3) is applied on both ends, and on the back side the area of stronger longitudinal solder (4).

The major conceptual difference between the present patent and the prior art, is the use of the prediction and inclusion of areas of expansion of the liquid for its transformation into ice and its tubular shape without damaging the package, i.e., the weak seal (3) will be broken at the proposed end(s) and the expansion generated in the change of state from liquid to solid will be assimilated normally by the package conformation, but limited by the strong seal (2) and stronger longitudinal (4), avoiding the early rupture of the package, ensuring its integrity.

The invention claimed is:

1. An individualized tubular package configured for making potable/mineral water ice cubes comprising: a first strong weld at a longitudinal ends of the package; a chamber wherein the chamber holds potable/mineral water for ice formation; at least one weak weld wherein the at least one weak weld is located on an opposite longitudinal side of the chamber from the first strong weld; at least one liquid expansion area wherein the liquid expansion area is located on an opposite side of the weak weld from the chamber; a second strong weld wherein the second-strong weld is located on an opposite side of the liquid expansion area from the weak weld; a front side (A) and back side (B); an impermeable biodegradable film located on a front side and back side of the tubular package; and a stronger longitudinal weld wherein the stronger longitudinal weld is located on the back side (B).

2. The individualized tubular package for making potable/mineral water ice cubes according to claim 1 wherein there is one liquid expansion area at each longitudinal end of the package for a total of two liquid expansion areas, wherein the two liquid expansion areas allow for discharge at either end of the package.

3. The individualized tubular package for making potable/mineral water ice cubes according to claim 1 further comprising two areas of strong solder applied on both ends of the package.

4. The individualized tubular package for making potable/mineral water ice cubes according to claim 1 further comprising two areas of weak solder expansion applied on both ends of the package, on the back side of an area of a stronger longitudinal solder.

* * * * *